US005819439A

United States Patent [19]

Sanchez

[11] Patent Number: 5,819,439

[45] Date of Patent: Oct. 13, 1998

[54] SNEAKER FOR BODYBUILDERS

[76] Inventor: Pablo L. Sanchez, 97-11 Horace Harding Expressway, Rego Park, N.Y. 11368

[21] Appl. No.: 368,857

[22] Filed: Jan. 5, 1995

[51] Int. Cl.[6] ..... A43B 7/22; A43B 7/20

[52] U.S. Cl. ..... 36/89; 36/50.1; 36/91

[58] Field of Search ..... 36/50.1, 89, 88, 36/103, 59 C, 91

[56] References Cited

U.S. PATENT DOCUMENTS

| | | | |
|---|---|---|---|
| 4,494,321 | 1/1985 | Lawlor | 36/59 C |
| 4,640,025 | 2/1987 | DeRenzo | 36/50.1 |
| 4,769,927 | 9/1988 | Liggett et al. | 36/88 |
| 4,918,841 | 4/1990 | Turner et al. | 36/114 |
| 4,947,560 | 8/1990 | Fuerst et al. | 36/88 |
| 5,224,279 | 7/1993 | Agnew | 36/59 C |

FOREIGN PATENT DOCUMENTS

| | | | |
|---|---|---|---|
| 4100156 | 7/1992 | Germany | 36/89 |
| 9004933 | 5/1990 | WIPO | 36/89 |

*Primary Examiner*—M. D. Patterson
*Attorney, Agent, or Firm*—Richard L. Miller, P.E

[57] ABSTRACT

A sneaker for a bodybuilder comprising an upper shoe having a vamp portion. An outer sole is connected to the upper shoe. The outer sole has a cavity extending transversely across the width of the outer sole near the heel of the outer sole. A stationary VELCRO strap built into the upper shoe extends through the cavity and over the vamp portion about an ankle of the bodybuilder, so that the bodybuilder can perform thigh exercises in comfort.

4 Claims, 3 Drawing Sheets

SNEAKER FOR BODYBUILDERS

BACKGROUND OF THE INVENTION

The instant invention relates generally to athletic shoes and more specifically it relates to a sneaker for bodybuilders.

Numerous athletic shoes have been provided in prior art that are adapted to prevent lateral foot movement to improve foot stability and comfort. For example, U.S. Pat. Nos. 4,769,927 to Liggett et al.; U.S. Pat. No. 4,918,841 to Turner et al. and U.S. Pat. No. 4,947,560 to Fuerst et al. all are illustrative of such prior art.

While these units may be suitable for the particular purpose to which they address, they would not be as suitable for the purposes of the present invention as heretofore described.

SUMMARY OF THE INVENTION

A primary object of the present invention is to provide a sneaker for a bodybuilder that will overcome the shortcomings of the prior art devices. Another object is to provide a sneaker for a bodybuilder that has hook and loop pile mating fastener material known by the trademark VELCRO (hook and loop fastener) that is formed on two straps, in which the first strap goes around the ankle and the second strap extends over the top of the foot to absorb pressure when performing exercises for the thigh muscles.

An additional object is to provide a sneaker for a bodybuilder that has deep molded treads in the outer sole in the area under the ball of the foot to maintain foot position during exercise of the calf muscles. A further object is to provide a sneaker for a bodybuilder that is simple and easy to use.

A still further object is to provide a sneaker for a bodybuilder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
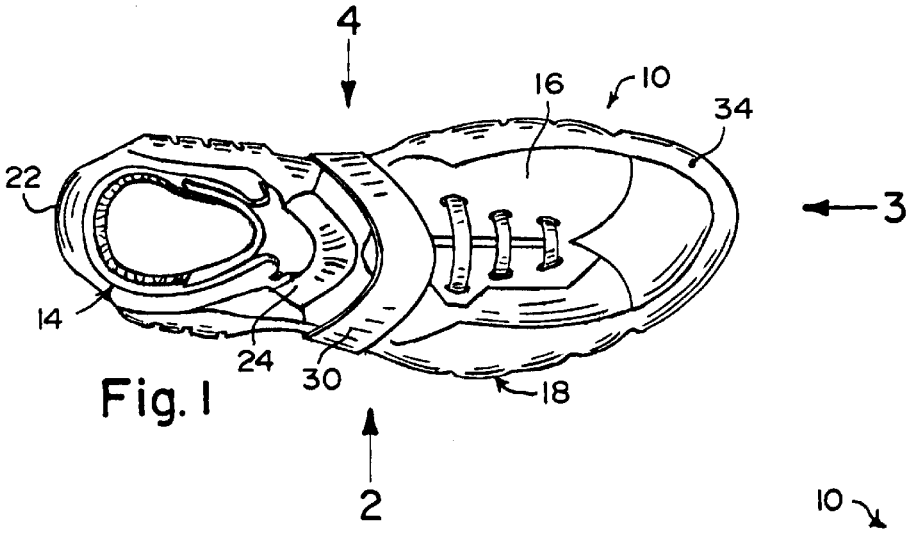
FIG. 1 is a top plan view of the instant invention illustrated for the right foot it being understood that for the left foot for this figure and all the figures that follow are mirror images thereof.
Figure 3:
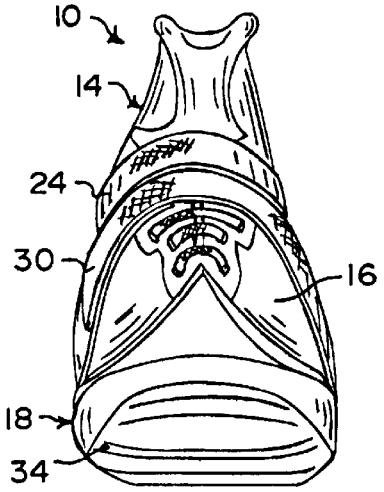
FIG. 3 is a front elevational view thereof taken in the direction of arrow 3 in FIG. 1.
Figure 2:
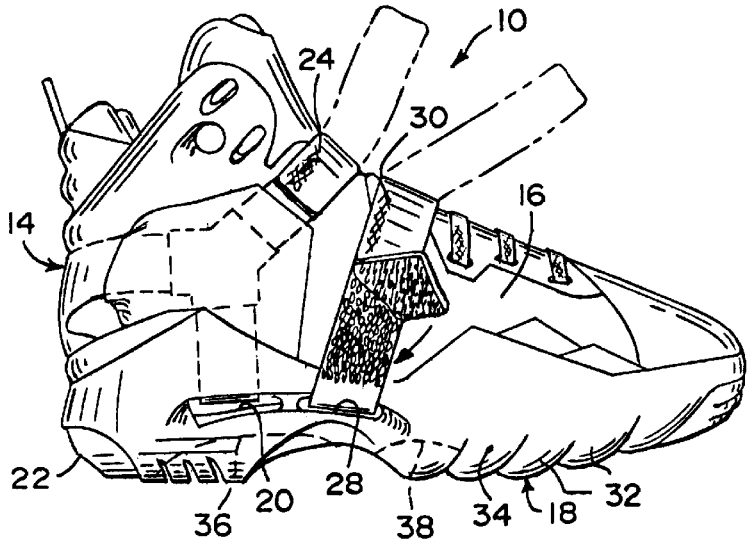
FIG. 2 is a right side elevational view thereof taken in the direction of arrow 2 in FIG. 1.
Figure 4:
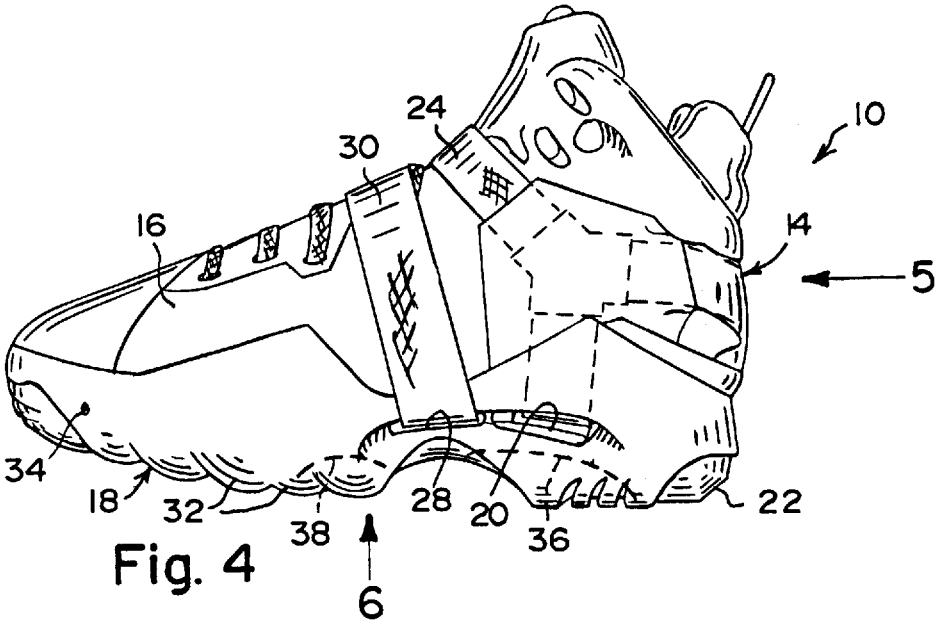
FIG. 4 is a left side elevational view thereof taken in the direction of arrow 4 in FIG. 1.
Figure 5:
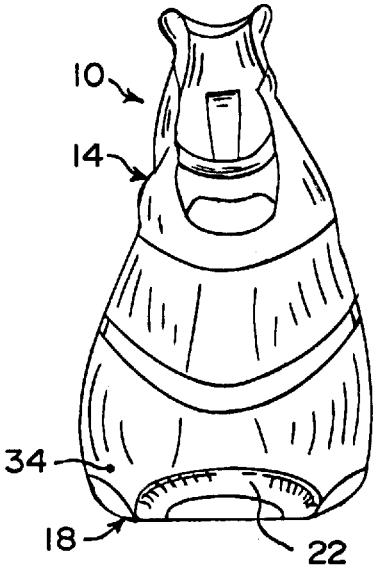
FIG. 5 is a rear elevational view thereof taken in the direction of arrow 5 in FIG. 4.
Figure 6:
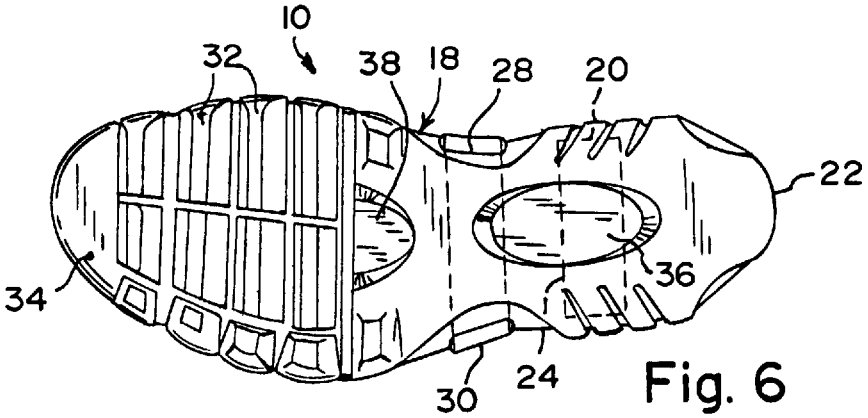
FIG. 6 is a bottom plan view thereof taken in the direction of arrow 6 in FIG. 4.
Figure 7:
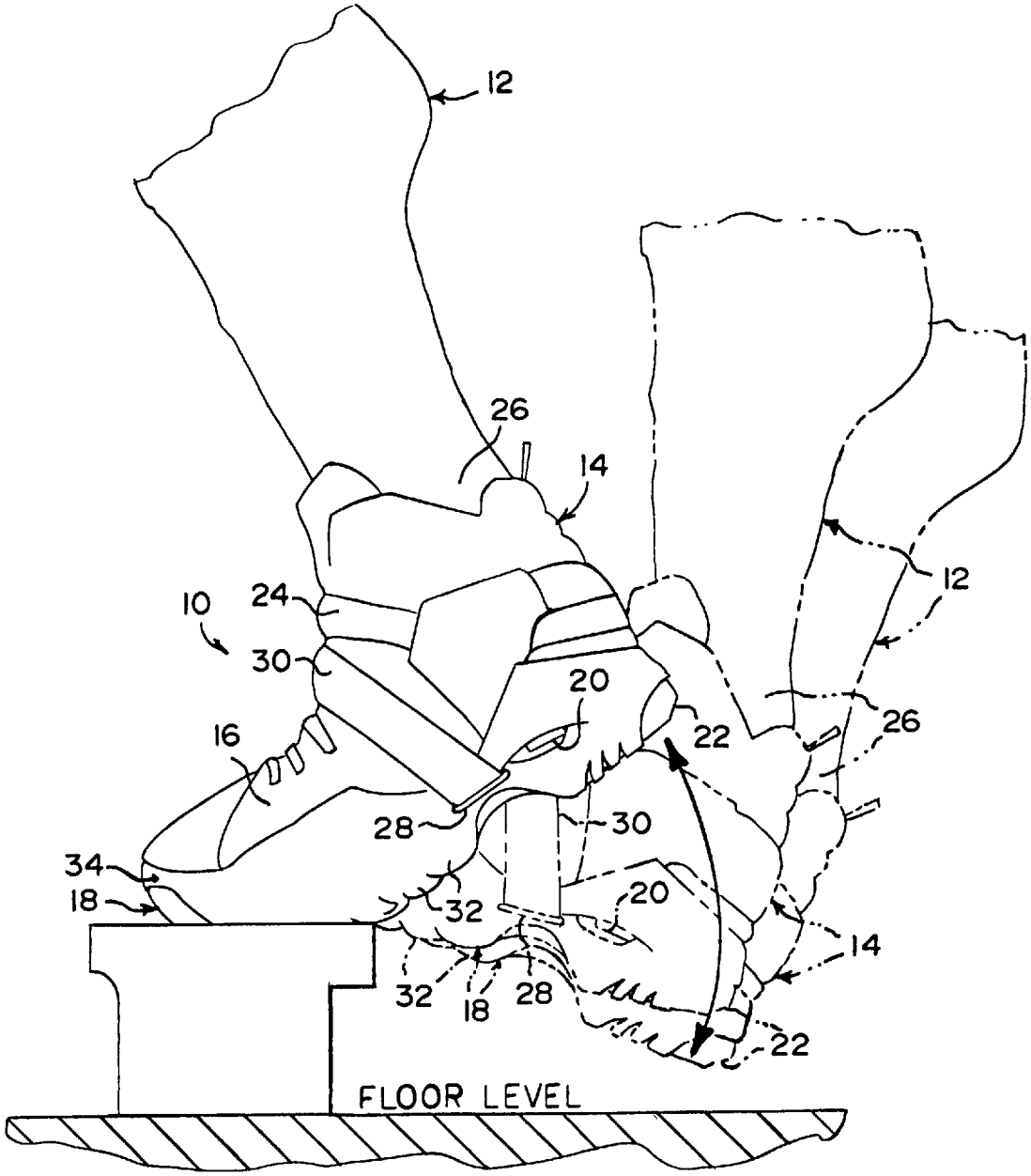
FIG. 7 is a left side elevational view illustrating the instant invention in use on a bodybuilder's foot.

Turning now descriptively to the drawings, in which similar reference characters denote similar elements throughout the several views, FIGS. 1 through 7 illustrates a sneaker 10 for a bodybuilder 12 comprising an upper shoe 14 having a vamp portion 16. An outer sole 18 is connected to the upper shoe 14. The outer sole 18 has a cavity 20 extending transversely across the width of the outer sole 18 near the heel 22 of the outer sole 18. A stationary VELCRO (hook and loop fastener) strap 24 built into the upper shoe 14 extends through the cavity 20 and over the vamp portion 16 about an ankle 26 of the bodybuilder 12, so that the bodybuilder 12 can perform thigh exercises in comfort.

The outer sole 18 has a second cavity 28 extending transversely across the width of the outer sole 18 in front of the first cavity 20 at the middle of the outer sole 18. A removable VELCRO strap 30 extends through the second cavity 28 over the vamp portion 16 of the upper shoe 14 and on top of a foot of the bodybuilder 12 to add more stability thereto.

The outer sole 18 has deep molded treads 32 in the area under the ball of the foot of the bodybuilder 12, so as to maintain foot position, stability and traction during exercises for the calf muscles. The outer sole 18 is fabricated from a durable elastomer material typical rubber or synthetic rubber 34 to withstand repeated use. It is molded into its desired shape and has a first concave depression 36 located in the middle of the outer sole 18 near the heel 22. A second concave depression 38 is located in the middle of the outer sole 18 in the deep molded treads 32, to provide increase stability and traction.

OPERATION OF THE INVENTION

To use the sneaker 10, the bodybuilder 12 places the foot into the upper shoe 14 and ties the laces provided. The stationary VELCRO strap 24 can then be snugly secured over the vamp portion 16 and about the ankle 26. The removable VELCRO (hook and loop fastener) strap 30 can also be snugly secured over the vamp portion 16 on top of the foot of the bodybuilder 12. The bodybuilder 12 can now perform the exercises to strengthen the thigh and calf muscles.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A sneaker for a bodybuilder comprising:

a) an upper shoe having a vamp portion;

b) an outer sole having a heel, a middle, an area under the ball of the foot of the bodybuilder and being connected to said upper shoe, said outer sole having a first cavity extending transversely across the width of said outer sole near the heel of said outer sole; and c) a stationary hook and loop fastener strap built into said upper shoe, extending through said first cavity and over said vamp portion about an ankle of the bodybuilder, so that the bodybuilder can perform thigh exercises in comfort.

2. A sneaker for a bodybuilder as recited in claim 1, further including:

a) said outer sole having a second cavity extending transversely across the width of said outer sole in front of said first cavity at the middle of said outer sole; and b) a removable hook and loop fastener strap extending through said second cavity over said vamp portion of said upper shoe and on top of a foot of the bodybuilder to add more stability thereto.

3. A sneaker for a bodybuilder as recited in claim 2, further including said outer sole having deep molded treads in the area under the ball of the foot of the bodybuilder, so as to maintain foot position, stability and traction during exercises for the calf muscles.

4. A sneaker for a bodybuilder as recited in claim 3, wherein said outer sole is fabricated from a durable elastomer material to withstand repeated use and is molded into its desired shape having a first concave depression located in the middle of said outer sole near the heel and a second concave depression located in the middle of said outer sole in said deep molded treads to provide increased stability and traction.

* * * * *